US006922375B2

(12) United States Patent
Shen

(10) Patent No.: US 6,922,375 B2
(45) Date of Patent: Jul. 26, 2005

(54) SUPER-THIN HANGING CLOCK

(76) Inventor: Li-Mei Shen, P.O. Box 90, Tainan City (TW)

( * ) Notice: Subject to any disclaimer, the term of this patent is extended or adjusted under 35 U.S.C. 154(b) by 322 days.

(21) Appl. No.: 10/388,489

(22) Filed: Mar. 17, 2003

(65) Prior Publication Data

US 2004/0184357 A1 Sep. 23, 2004

(51) Int. Cl.[7] ..... G04B 19/02; G04B 37/00; G04C 9/02

(52) U.S. Cl. ..... 368/220; 368/88; 368/187; 368/309

(58) Field of Search ..... 368/76, 80, 88, 368/185, 187, 220, 223, 276, 297, 298, 309, 310

(56) References Cited

U.S. PATENT DOCUMENTS 3,461,663 A * 8/1969 Albinger, Jr. et al. ..... 368/204
3,783,605 A * 1/1974 Yasuda ..... 368/185
3,966,736 A * 6/1976 Szmuszkovicz ..... 540/555
4,382,695 A * 5/1983 Rinaldi et al. ..... 368/220
4,465,378 A * 8/1984 Maurer et al. ..... 368/88
4,805,161 A * 2/1989 Kroner ..... 368/220
5,671,192 A * 9/1997 Schaffel ..... 368/47
5,999,495 A * 12/1999 Hashizume et al. ..... 368/80

* cited by examiner

*Primary Examiner*—Randy Gibson
*Assistant Examiner*—Jeanne-Marguerite Goodwin

(57) ABSTRACT

A super-thin hanging clock includes a housing, a transparent cover, and a core that has a first shell, a second shell fitted with the first shell and having a swingable lid to hide the battery and a through hole for the button to pass through, a stator, a PC board with a control circuit, an electrically time-adjusting button, an electronic battery and a transmitting gear system consisting of a rotor, a transmitting gear, a minute gear, a front hour gear and an hour gear, whereby a coil of the stator is powered to rotate the rotor to rotate the transmitting gear provided with a toothed shaft engaging the minute gear provided with a toothed shaft engaging the front hour gear provided with a toothed shaft engaging the hour gear provided with a shaft connected to a shaft of a needle unit, thus making up the super-thin hanging clock.

3 Claims, 4 Drawing Sheets

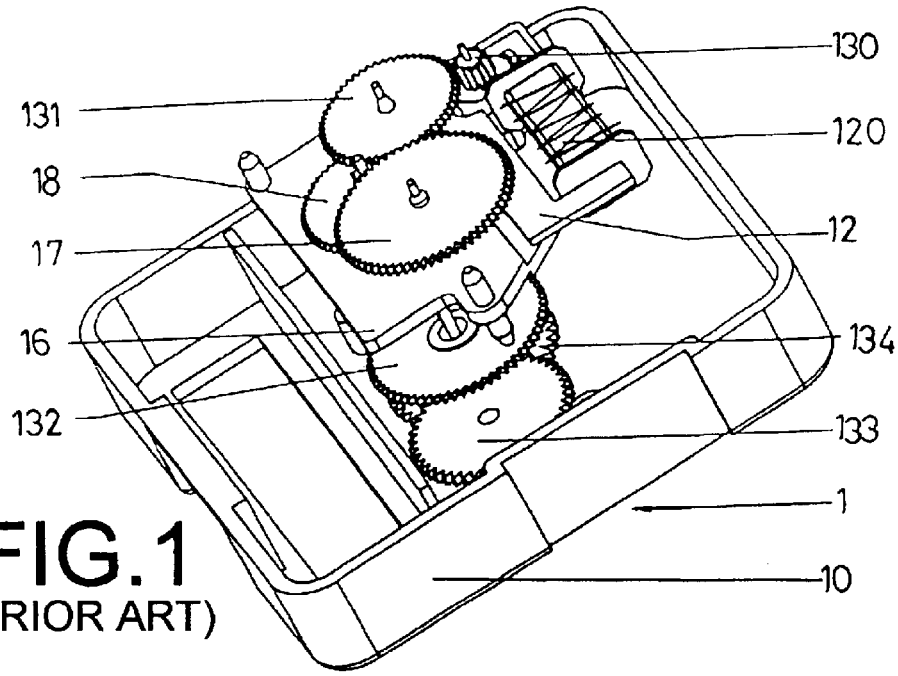
FIG.1
(PRIOR ART)
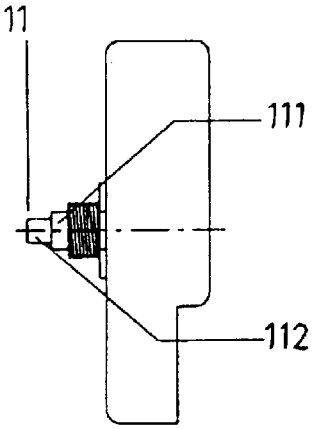
FIG.2
(PRIOR ART)
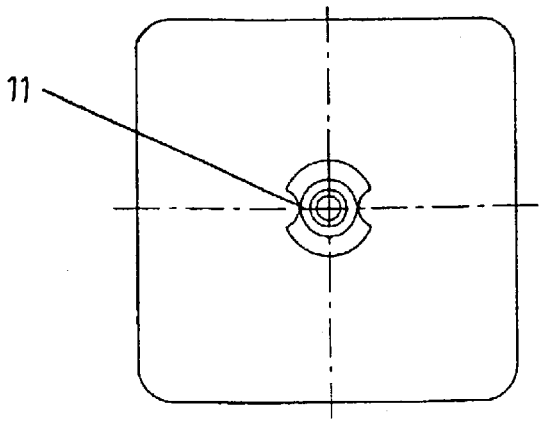
FIG.3
(PRIOR ART)
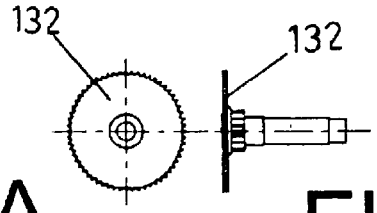
FIG.4A
(PRIOR ART)
FIG.4B
(PRIOR ART)

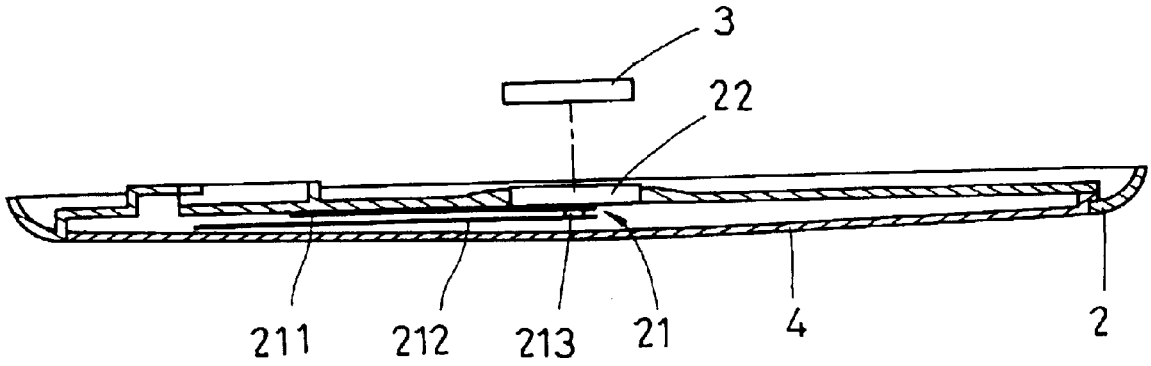
FIG.6
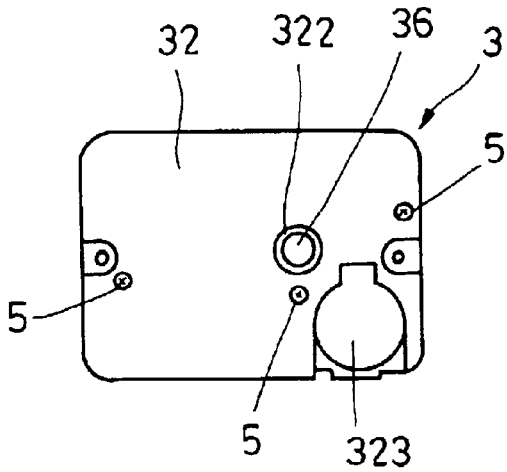
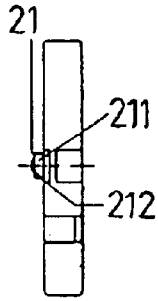
FIG.7 FIG.8

SUPER-THIN HANGING CLOCK

BACKGROUND OF THE INVENTION

1. Field of the Invention

This invention relates to a super-thin hanging clock, particularly to one designed to have super-thin parts, an electronic battery and an electrically time-adjusting button, with its thickness and weight greatly reduced, with material and cost also lessened as possible, with noise caused by movement of the parts also decreased, and with an outer appearance beautified.

2. Description of the Prior Art

A conventional hanging clock, shown in FIGS. 1, 2, 3, 4A and 4B, includes a housing 1 with a lower housing 10, a separating plate 16 for positioning each transmitting gear in parallel, a PC board fixed with the lower end of the separating plate 16, a stator 12 with a coil 120 provided at one side of the separating plate 16, a rotor 130 fixed at one end of the stator 12, a transmitting gear 131 engaging the rotor 130, a second gear 18 engaging the transmitting gear 131, a front minute gear 17 engaging the second gear 18, the front minute gear engaging a minute gear 132 fixed on the same shaft of the second gear 18, the minute gear 132 engaging a front hour gear 133, the front hour gear engaging an hour gear fixed on the same shaft of the minute gear 132, an adjusting button provided on an upper cover, and a needle unit consisting of an hour needle 111 and a minute needle 112 moved by the transmitting gear unit.

However, the conventional hanging clock has the following disadvantages.

The transmitting gear system is too complicated, having too many gears as much as seven, and the separating plate is used for fixing the gears, making the clock complicated and heavy and using too much material.

1. The time is adjusted by a mechanical mode, not easy to handle-and limited in its accuracy.

2. It has a second needle, a minute needle and an hour needle, and there arises comparatively large friction between the needles and the transparent cover, affecting movement of the needles.

3. It uses an acid or alkaline battery, forcing the thickness of the clock become big, with used batteries polluting the environment.

4. Its size is comparatively large, and heavy owing to its whole structure complicated.

SUMMARY OF THE INVENTION

This invention has been devised to offer a super-thin hanging clock with a simplified structure with super-thin parts, using an electronic battery and an electrically time-adjusting button.

The feature of the invention is a core including a first shell, a second shell, a stator, a transmitting gear system, a PC board, an electrically time-adjusting button, and an electronic battery. The stator has a coil wound thereon and is contained in the first shell, having an extended end facing a rotor of the transmitting gear system, which consists of the rotor, a transmitting gear, a minute gear, a front hour gear, and an hour gear. The rotor engages the transmitting gear, which has a shaft with circumferential teeth to engage with the minute gear. The minute gear has a shaft with circumferential teeth to engage with the front hour gear, which has a shaft with circumferential teeth to engage with the hour gear, the hour gear has the same shaft as the minute gear, also having the shaft axis connected with the needle unit. The PC board is contained in the first shell, and the electrically time-adjusting button is fixed on the PC board, with the electronic battery positioned at one side of the PC board. The second shell fits with the back surface of the first shell, having a through hole for the electrically time-adjusting button to pass through. A swingable battery lid is further provided on the second shell to hide the electronic battery.

BRIEF DESCRIPTION OF DRAWINGS

This invention will be better understood by referring to the accompanying drawings, wherein:

FIG. 1 is a perspective view of a core of a conventional hanging clock;

FIG. 2 is a side view of needles of the conventional hanging clock;

FIG. 3 is a front view of the core of the conventional hanging clock;

FIG. 4A is a front view of a minute gear in the conventional hanging clock;

FIG. 4B is a side view of a minute gear in the conventional hanging clock, showing the height of the minute gear;

FIG. 6 is an upper view of the structure of the super-thin hanging clock in the present invention;

FIG. 7 is a rear view of the core of the super-thin hanging clock in the present invention;

FIG. 8 is a side view of the structure of needles of the super-thin hanging clock in the present invention;

DETAILED DESCRIPTION OF THE PREFERRED EMBODIMENT

Figure 5:
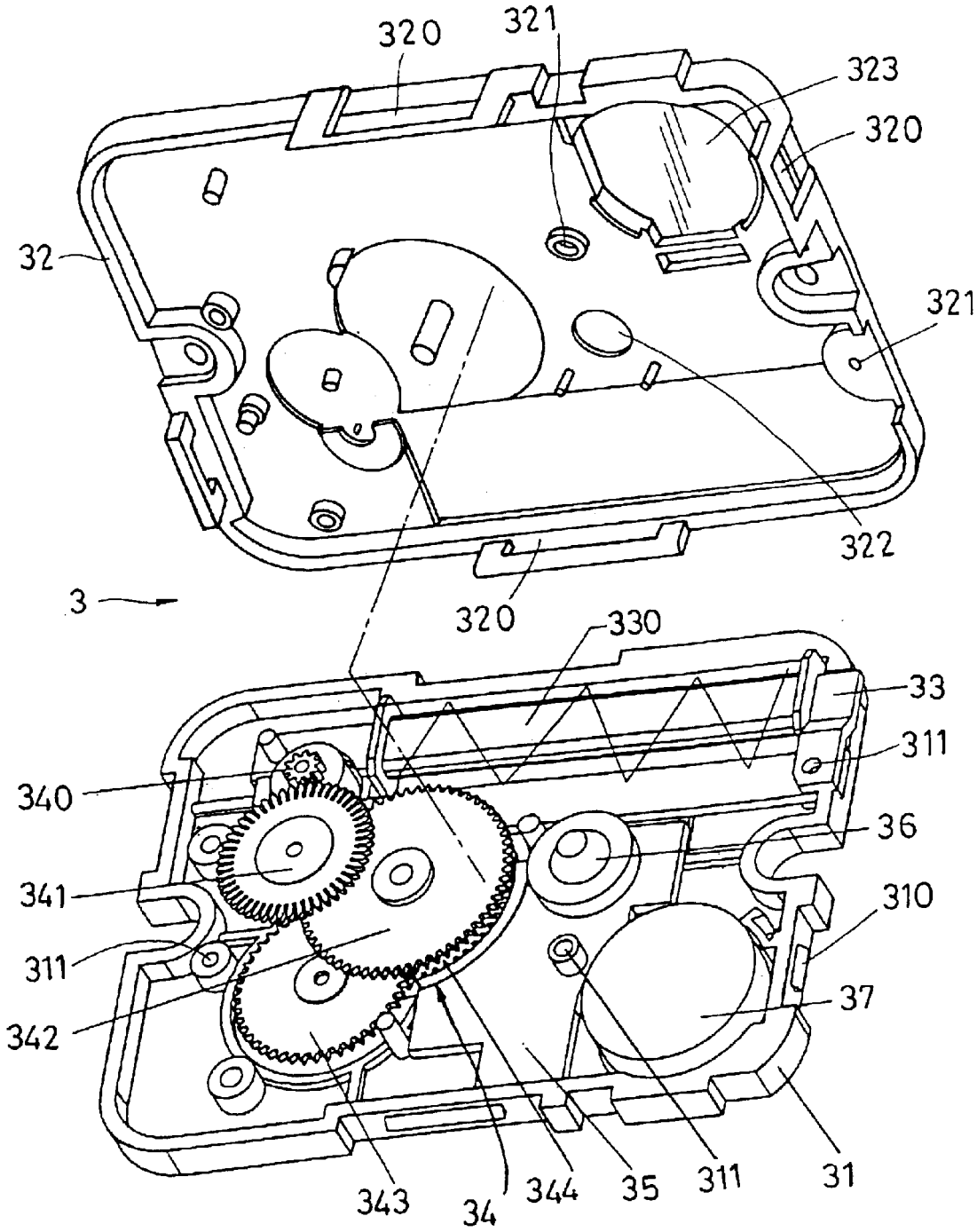
FIG. 5 is a perspective view of a core of a super-thin hanging clock in the present invention.
Figures 9A, 9B:
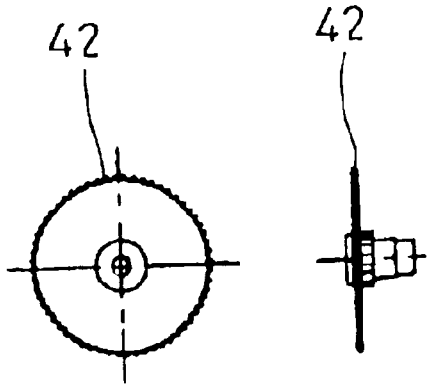
FIG. 9A is a front view of a minute gear of the super-thin hanging clock in the present invention.
FIG. 9B is a side view of the minute gear of the super-thin hanging clock in the present invention, showing the height of the minute gear; and, FIG. 10 is a side view of the structure of a transmitting gear system in the present invention.
Figure 10:
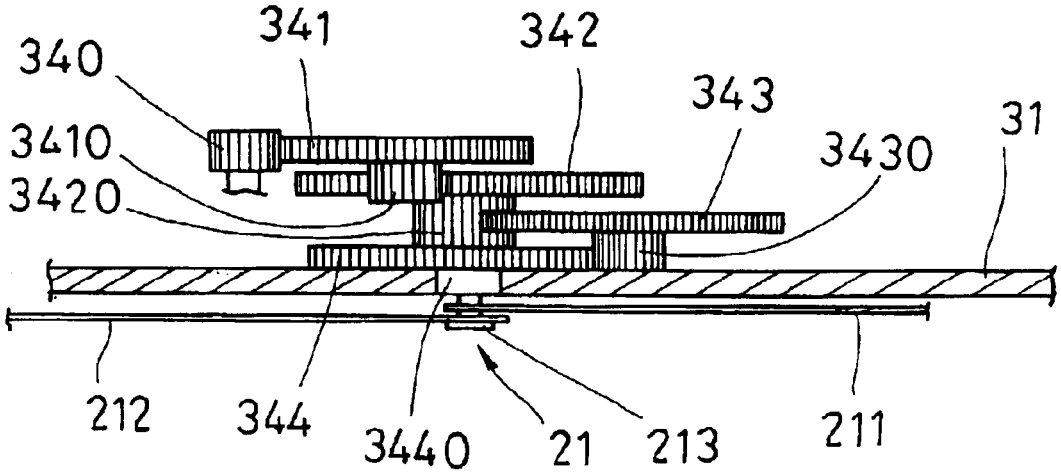

A preferred embodiment of a super-thin hanging clock in the present invention, as showing FIGS. 5–10, includes a housing 2, a core 3, a transparent cover 4 as main components combined together.

The housing 2 has its front surface formed with a recess for a needle unit 21 to be combined in the recess. The needle unit 21 consists of two super-thin needles made of soft plastic—an hour needle 211 and a minute needle 212. The hour needle 211 and the minute needle 212 have their one end connected with a shaft 213.

The core 3 is positioned in a core recess 22 formed in a back surface of the housing 2, consisting of a first shell 31, a second shell 32, a stator 33, a transmitting gear system 34, a PC board 35, an electrically time-adjusting button 36, and an electronic battery 37.

The transmitting gear system consists of a rotor 340, a transmitting gear 341, a minute gear 342, a front hour gear 343 and an hour gear 344.

The first shell 31 contains the stator 33 wound with a coil 330, and the rotor 340 of the transmitting gear system 34 is positioned at an extended end of the stator 33, engaging with the transmitting gear 341. The transmitting gear 341 has a shaft formed with circumferential teeth 3410 to engage with the minute gear 342, which then has a shaft formed with circumferential teeth 3420 to engage with the front hour gear 343. The front hour gear 343 then has a shaft formed with circumferential teeth 3430 to engage with the hour gear 344 having the same shaft with the minute gear 342. The hour gear 344 also has its own shaft 3440 to connect with the shaft 213 of the needle unit 21.

The PC board 35 is positioned properly in the first shell 31, and the electrically time-adjusting button 36 is fixed on the PC board 35, and the battery 37 is positioned at one side of the PC board 35.

The first shell 31 and the second shell 32 fit with each other, defining a space for containing the stator 33 and the transmitting gear system 34, the PC board 35, the electrically time-adjusting button 36 and the electronic battery 37. The first shell 31 has plural hook blocks 310 at the circumferential side edges, and the second shell has 32 a hook 320 formed in the corresponding locations as the hook blocks 310 of the first shell 32 to keep the first and the second shell 31 and 32 stably fitting together. Then the first and the second shell 31 and 32 also have related threaded holes 311 and 312 for screws 5 to lock together the first and the second shell 31 and 32 in the fitting-together condition.

Further, the second shell 32 has a through hole 322 for the electrically time-adjusting button 36 to pass through, and a swingable battery lid 323 is provided at the location facing the battery 37. The transparent cover 4 is laid on the front side of the housing 2.

In order to save the space in the super-thin hanging clock, the gear-transmitting ratio of the invention is made different from that of the conventional hanging clock, with the height of the gears reduced, and with the resistance of the stator changed. When the coil 330 is powered with a voltage of a frequency of 32,768 kHz, the rotor 340 is rotated with a slow speed of 0.5 round/minute, with the transmitting gear 341 and then the minute gear 342 in order rotated one round every 60 minutes. Then the hour gear 344 engaging with the front hour gear 343 rotates one round every 720 minutes (or 12 hours).

The gears of the super-thin hanging clock in the invention do not have the second gear and a front minute gear used in the conventional handing clock, having the following data.

The teeth number of the rotor 340 is 10, with rotation speed being 0.5 r/m.

The teeth number of the transmitting gear 341 is 50, with the teeth 3410 number of its shaft being 10.

The teeth number of the minute gear 342 is 60, with the teeth 3420 number of its shaft being 15.

The teeth number of the front hour gear 343 is 45, with the teeth 3430 number of its shaft being 12.

The teeth number of the hour gear 344 is 48.

The rotating speed of the minute gear 342 is:

$$0.5\ r/m\times(10\times10)/(50\times60)=1\ r/60\ m=1\ h.$$

The rotating speed of the hour gear is:

$$1\ r/60\ m\times(15\times12)/(50\times60)=1\ r/720\ m=1\ r/12\ h.$$

The transmitting ratio=the rotating speed of the minute gear: the rotating speed of the hour gear=12:1.

As can be seen from the above data, the core of the hanging clock in the invention is made different from that of the conventional one, with the rotating speed of the rotor and the teeth number of the transmitting gear altered to reduce the number of the gear teeth by removing the second gear and the front minute gear in the conventional hanging clock, simplifying the transmitting gear system and consequently reducing the thickness of the core.

Further, a control electric circuit is provided on the PC board in the hanging clock in the invention, connected with the electrically time-adjusting button 6. When the electrically adjusting button 6 is pressed once or more, the voltage of the coil 330 is altered to make the rotor 340 change its rotating speed, letting the transmitting gear system alter their rotating speed so as to adjust the time. If the button 6 is presses once, the rotor 340 moves the minute needle 212 forward one minute, that is, advancing the time one minute. If the button 6 is kept pressed, the rotor 40 and the minute needle 212 also continue to move forward until the time is adjusted as wanted, and then the button 6 is released.

As the needle unit is composed of two super-thin needles made of soft plastic and the PC board is contained in the first shell, the super-thin hanging clock in the invention has the following advantages.

1. It has removed the second gear and the front minute gear used in the conventional hanging clock, reducing the thickness of the core, with its weight and material also reduced.

2. It saves the cost for packing, storing, transporting and manufacturing.

3. It uses an electronic battery, which is easy to recycle, not polluting the environment.

4. It has the electrically time-adjusting button for easily adjusting the time quickly, convenient to use.

5. It uses two needles made of 0.025 mm super-thin soft plastic, enabling the distance between the clock surface and the hour and the minute needle and between the needles and the transparent upper cover very small. Even if the needles should make friction with the clock surface, their elasticity is large enough to move forward, reducing the height of the needles substantially to make the thickness of the clock super-thin.

6. It economizes the needed space for hanging on a wall, increasing its beautiful appearance.

While the preferred embodiment of the invention has been described above, it will be recognized that various modifications may be made therein and the appended claims are intended to cover all such modifications that may fall within the spirit and scope of the invention.

What is claimed is:

1. A super-thin hanging clock comprising a housing, a core, and a transparent cover, said housing having a front surface recessed to combine a needle unit therein, said housing having a back surface provided with a core recess for containing said core therein, said transparent cover laid on the front side of said housing;

characterized by said core comprising a first shell, a second shell, a stator, a transmitting gear system, a PC board, an electrically time-adjusting button, and a battery; and, said stator having a coil wound thereon and an extended end to face a rotor of said transmitting gear system, said transmitting gear system consisting of the rotor, a transmitting gear, a minute gear, a front hour gear and an hour gear, said rotor engaging said transmitting gear, said transmitting gear having a shaft provided with circumferential teeth, said circumferential teeth of said transmitting gear engaging said minute gear, said minute gear having a shaft provided with circumferential teeth, said circumferential teeth of said minute gear engaging said front hour gear, said front hour gear having a shaft provided with circumferential teeth, said circumferential teeth of said front hour gear engaging said hour gear, said hour gear having the same shaft as said minute gear, said same shaft of said hour gear having its axis connected with the needle unit, said PC board positioned in said first shell, said electrically time-adjusting button fixed on said PC board, said electronic battery positioned at one side of said PC board, said second shell laid on the back surface of said first shell to define a space for containing the other components of said core, said second shell having a through hole for said electrically time-adjusting button to pass through, and a swingable lid provided to cover on said electronic battery.

2. The super-thin hanging clock as claimed in claim 1, wherein said needle unit consists of an hour needle and a minute needle made of super-thin soft plastic.

3. The super-thin hanging clock as claimed in claim 1, wherein said first shell has plural hook blocks formed on circumferential side edges, said second shell has plural hooks in corresponding locations of said plural hook of said first shell, said first and said second shell also have corresponding threaded holes for screws to lock said first and said second shell in a fitting-together position.

* * * * *